US005775244A

United States Patent [19]

Nakayama et al.

[11] Patent Number: 5,775,244

[45] Date of Patent: Jul. 7, 1998

[54] NEEDLE CLAMPING MECHANISM OF A SEWING MACHINE

[75] Inventors: Koichi Nakayama; Shinji Kojima, both of Utsunomiya, Japan

[73] Assignee: The Singer Company N.V., Curaco, Netherlands Antilles

[21] Appl. No.: 698,505

[22] Filed: Aug. 15, 1996

[30] Foreign Application Priority Data

Aug. 18, 1995 [JP] Japan ..... 7-232091

[51] Int. Cl.[6] ..... D05B 55/02

[52] U.S. Cl. ..... 112/226

[58] Field of Search ..... 112/226, 222, 112/227; 223/102

[56] References Cited

U.S. PATENT DOCUMENTS

| | | | |
|---|---|---|---|
| 3,348,508 | 10/1967 | Eguchi et al. | 112/226 |
| 4,329,934 | 5/1982 | Hanyu et al. | 112/226 |
| 4,883,007 | 11/1989 | Nagasaka | 112/226 |

*Primary Examiner*—Peter Nerbun
*Attorney, Agent, or Firm*—McCormick, Paulding & Huber

[57] ABSTRACT

A needle clamping mechanism capable of preventing tip end positions of a pair of needles from being set back or forth and right or left, thereby obtaining excellent sewing performance. The needle clamping mechanism comprises a needle bar comprising a needle bar body, a protrusion protruding downward from a lower surface of the needle bar body and being semicircular in cross section, and having a flat surface portion at a chord thereof, a needle clamp member which the needle bar is engaged in a fixed to, the needle clamp member having a recess for receiving the needle bar body, a needle containing hole being opened at a lower end surface of the needle clamp member, the needle containing hole comprising a semicircular cross sectional portion for receiving the protrusion of the needle bar and a pair of circular arc grooves for receiving needle circular portions provided at upper ends of a pair of needles individually, wherein the needles respectively received in the pair of circular arc grooves are respectively pressed by tip ends o0: set screws which are respectively screwed into the needle clamp member, and each of the needle circular portions is pressed against each of side walls of the needle containing hole, a needle flat surface portion at the upper end of each of the needles is pressed against and fixed to a flat surface portion of the protrusion.

2 Claims, 9 Drawing Sheets

NEEDLE CLAMPING MECHANISM OF A SEWING MACHINE

BACKGROUND OF THE INVENTION

1. Field of the Invention

The present invention relates to a needle clamping mechanism of a sewing machine, particularly to a needle clamping mechanism of an overlock sewing machine for carrying out an overlock stitch to prevent a sewn cloth from fraying at an edge thereof.

2. Prior Art

As a prior art overlock sewing machine, there is known a type for carrying out a two-needle-four-thread overlock stitch. The overlock sewing machine carrying out two-needle-four-thread overlock stitch carries out a #514 seam pattern according to seam pattern classification JIS-L0120. A needle clamp member, which carries out the two-needle-four-thread overlock stitch, uses two needles which are arranged in parallel with each other in a direction perpendicular with respect to a cloth feeding direction.

As shown in FIGS. 12 through 16, a needle clamp member 50 is fixed to a lower end portion of a needle bar 56. A needle hole 51 having a pair of semicircular hole portions 51*a* is defined in the needle clamp member 50 wherein needles f (left and right needles f1 and f2) are respectively inserted into the semicircular hole portions 51*a*, and they are pressed by the conical tip ends of individual needle clamp screws 52 and 53, thereby fixing each of the needles f1 and f2.

However, the prior art needle clamping unit has the following technical problems.

(1) The needles f are pressed by the tip end portions of the needle clamp screws 52 and 53 which are respectively screwed into the needle hole 51 of the needle clamp member 50 so that the needles f are pressed against and fixed to the side walls of each of the hole portions 51*a* and a rear wall 51*b* of the needle hole 51. Since the needle clamp member 50 is formed by casting, it is difficult from a manufacturing point of view to provide accurately construct the side walls of each hole 51*a* and the rear wall 51*b* of the needle hole 51 so as not to form a bent portion at the needle hole 51. As a result, the tip end positions of the needles f1 and f2 are liable to be set back or forth as shown by the broken lines in FIG. 15, and also those are liable to be set right or left as shown by broken lines of FIG. 16, which inf1uences inferiorly upon the sewing performance.

(2) A spacer 54 provided with a protrusion 54*a* is pressed into and fixed to the needle clamp member 50 so as to set the difference t between the tip end portions of the needles f1 and f2. However, this mechanism requires a large number of parts and takes time and labor for pressing, and hence it is complex in structure and is difficult to be manufactured, and costs high.

(3) The needle hole 51 of the needle clamp member 50 cannot be seen if it is not viewed from the lower side thereof. Accordingly, there is such a drawback that the fitting of the needles f1 and f2 is poor in workability.

Next the reason for setting the difference t between the tip ends of the needles f1 and f2 will now be described with reference to FIGS. 17 through 19.

The overlock sewing machine comprises the needles f1 and f2 respectively having a needle thread and movable vertically, and a right looper, not shown, having a right looper thread inserted into a thread hole defined in the upper end thereof and being operable to cross with a moving direction of a product to be sewn (workpiece), and a left looper 55 having a left looper thread being inserted into a thread hole 55*a* defined therein and being swingable right and left, wherein these needles f1 and f2, and the left and right loopers cooperate with one another so as to carry out an overlock stitch.

In the overlock sewing machine, the left looper 55 hooks the needle thread by the reciprocal motion along an arc N about a left looper shaft 58 which acts as a fulcrum as shown in FIGS. 17 and 19. Since the needle bar 56 moves upward during the reciprocal motion of the left looper 55 along the arc N, the height of the left needle f1 is the same as that of the right needle f2, the position of the right needle f2 when the tip end of the left looper 55 hooks the needle thread of the right needle f2 the needle thread is higher than that of the left needle f1 when the tip end of the left looper 55 hooks the needle thread of the left needle f2. Accordingly, a distance B between the tip end of the left looper 55 and the tip end of the right needle f2 shown in FIG. 19 is shorter than a distance A between the tip end of the left looper 55 and the tip end of the left needle f1. M shows a rising motion of the needle bar 56.

Since it is preferable that both distances are equal, namely, A=B, the difference t is needed between the tip end positions of the left and right needles f1 and f2.

SUMMARY OF THE INVENTION

The present invention has been made to solve the technical problems of the prior art and the needle clamping mechanism of the present invention is as follows.

According to the first aspect of the invention, a needle clamping mechanism comprises a needle bar 2 comprising a needle bar body 2*a* being circular in cross section, a protrusion 2*b* protruding downward from a lower surface of the needle bar body 2*a* and being semicircular in cross section, and having a flat surface portion 2*c* at a chord thereof, a needle clamp member 1 which the needle bar 2 is engaged in and fixed to, the needle clamp member 1 having a recess 1*a* being circular in cross section at an upper end for receiving the needle bar body 2*a*, a needle containing hole 4 connected to the recess 1*a* and extending in parallel with an axial line of the needle bar body 2*a*, and opened at a lower end surface of the needle clamp member 1, the needle containing hole 4 comprising a semicircular cross sectional portion 4*a* for receiving the protrusion 2*b* of the needle bar 2 and a pair of circular arc grooves 4*c* which respectively confront the cross sectional portion 4*a* and receive needle circular portions fa provided at upper ends of a pair of needles f1 and f2 individually, wherein the needles f1 and f2 respectively received in the pair of circular arc grooves 4*c* are respectively pressed by tip ends of set screws 5 and 6 which are respectively screwed into the needle clamp member 1, and each of the needle circular portions fa is pressed against each of side walls 4*d* and 4*e* of the needle containing hole 4, a needle flat surface portion fb formed by the chord of the needle circular portions fa (namely, formed by cutting a part of the needle circular portions fa) at the upper end of each of the needles f1 and f2 is pressed against and fixed to the f1at surface portion 2*c* of the protrusion 2*b*.

According to a second aspect of the invention, the needle clamping mechanism in the first aspect of the invention is characterized by further comprising a notch groove portion 2*e* provided at a part of a boundary between the protrusion 2*b* and needle bar body 2*a* of the needle bar 2, the notch groove portion 2*e* being directed perpendicularly to the flat surface portion 2*c*, wherein an upper end surface of the left needle f1 is brought into contact with an upper surface 2*f* of the notch groove portion 2*e*, the upper end surface of the right needle f2 is brought into contact with a lower surface 2*g* of the needle bar body 2*a* connected to the upper end of the flat surface portion 2*c*, and a difference t is set between tip end positions of the needles f1 and f2.

According to a third aspect of the invention, the needle clamping mechanism in the first aspect of the invention is characterized in that the lower end of the protrusion 2*b* of the needle bar 2 protrudes from the lower surface of the needle clamp member 1.

According to the first aspect of the invention, the lower end portion of the needle bar 2 is engaged in tje recess 1*a* of the needle clamping member 1 and the needle bar 2 is detachably fixed to the needle clamp member 1 by set screws. Then, the two needles f1 and f2 are mounted in the needle containing hole 4 of the needle clamp member 1. When the left needle f1 is intended to be fitted in the needle containing hole 4, it is inserted into the needle containing hole 4 from the left end lower part thereof and is retained by the left circular arc grooves 4*c*. Thereafter, the needle clamp screw 5 is screwed into a screw hole of the needle clamp member 1. As a result, the tip end of the needle clamp screw 5 is pressed against the inner peripheral surface of the needle circular arc portion fa of the left needle f1. In this state, the outer peripheral surface of the needle circular arc portion fa of the left needle f1 is pressed against the side wall 4*d* formed at the left end surface of the needle containing hole 4 while the needle flat surface portion fb formed by the chord of the needle circular arc portion fa at the upper end of the left needle f1 is pressed against the flat surface portion 2*c* of the needle bar 2, thereby positioning the left needle f1 in the needle containing hole 4.

When the right needle f2 is fitted in the needle containing hole 4, the right needle f2 is inserted into the needle containing hole 4 from the right end lower part thereof and is retained by the right circular arc groove 4*c*. A needle clamp screw 6 is screwed into a screw hole of the needle clamp member 1. As a result, the tip end of the needle clamp screw 6 is pressed against the inner peripheral surface of the needle circular arc portion fa of the right needle f2. In this state, the outer peripheral surface of the circular arc portion fa of the right needle f2 is pressed against the side wall 4*e* formed at the right end surface of the needle containing hole 4 while the needle flat surface portion fb formed by the chord of the needle circular arc portion fa at the upper end of the right needle f2 is pressed against the flat surface portion 2*c* of the needle bar 2, thereby positioning the right needle in the needle f2 containing hole 4.

According to the second aspect of the invention, the difference t is formed at the tip end positions of the two needles f1 and f2 having the same length in a state where the two needles f1 and f2 are respectively fitted in the needle containing hole 4 of the needle clamp member 1 owing to the stepped portion between a lower surface 2*g* of the needle bar body 2*a* having no notch groove portion 2*e* and the upper surface 2*f* of the notch groove portion 2*e*.

According to the third aspect of the invention, when the needles f1 and f2 are fitted in the needle containing hole 4 of the needle clamp member 1, the needle flat surface portions fb of the two needles f1 and f2 are moved upward while they are brought into contact with and guided by the lower end of the flat surface portion 2*c* of the protrusion 2*b* so that they can be retained by the circular grooves 4*c*. The two needles f1 and f2 are further moved upward after they are retained by the circular arc grooves 4*c*.

PREFERRED EMBODIMENT OF THE INVENTION

A needle clamping mechanism according to a preferred embodiment of the present invention will be described with reference to FIGS. 1 through 11.

Figure 7:
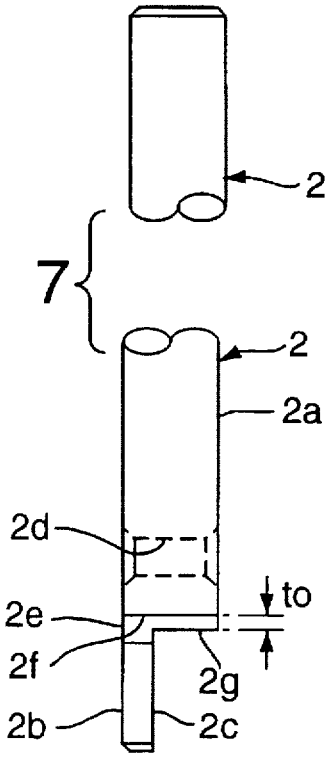
FIG. 7 is a side view of a needle bar in FIG. 1 a part of which is cut off.
Figure 8:
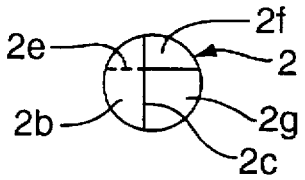
FIG. 8 is a bottom view of a needle bar in FIG. 7.
Figure 9:
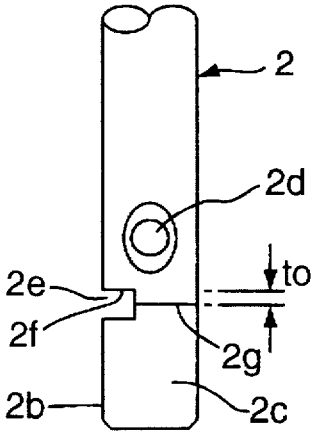
FIG. 9 is a front view of the needle bar in FIG. 7.

A needle clamping mechanism of an overlock sewing machine comprises a needle bar 2 which is supported by an arm of the overlock sewing machine (not shown) at the upper end thereof so as to be vertically movable, a needle clamp member 1 in which the lower end portion of the needle bar 2 is engaged, wherein a set screw 3 is screwed into the female screw portion 1*c* of the needle clamp member 1 so that a shaft of the set screw 3 is retained by a through hole 2*d* of the needle bar 2, whereby the needle bar 2 is detachably fixed to the needle clamp member 1. A recess 1*a* which is circular in cross section is formed at the upper end of the needle clamp member 1. The needle bar 2 has a round rod shape as a whole as shown in FIGS. 7 through 9, and it comprises a needle bar body 2*a* which is circular in cross section and has a round rod shape at the upper side, and a protrusion 2*b* which is cut at one side by a cut surface which is extending right and left protrudes downward from a lower surface of the needle bar body 2*a*. Meanwhile, the protrusion 2*b* is semicircular in cross section, and the chord forms a flat surface portion 2*c*. The flat surface portion 2*c* and the lower surface 2*g* of the needle bar body 2*a*, described later, are formed with high accuracy by machining the needle bar 2.

A notch groove portion 2*e* is formed at a part of a boundary (left end as viewed from the front thereof) between the protrusion 2*b* and the needle bar body 2*a* respectively of the needle bar 2 when the notch groove portion 2*e* is arranged perpendicularly (back and forth) with respect to the flat surface portion 2*c* as shown in FIGS. 7 and 9. A step difference to is formed in a direction of the height of the needle bar body 2*a* between the lower surface 2*g* of the needle bar body 2*a* where the notch groove portion 2*e* is not formed and the upper surface 2*f* of the notch groove portion 2*e*. The notch groove portion 2*e* is formed by cutting a part of the needle bar 2 in a rectangular shape by machining.

Figure 10:
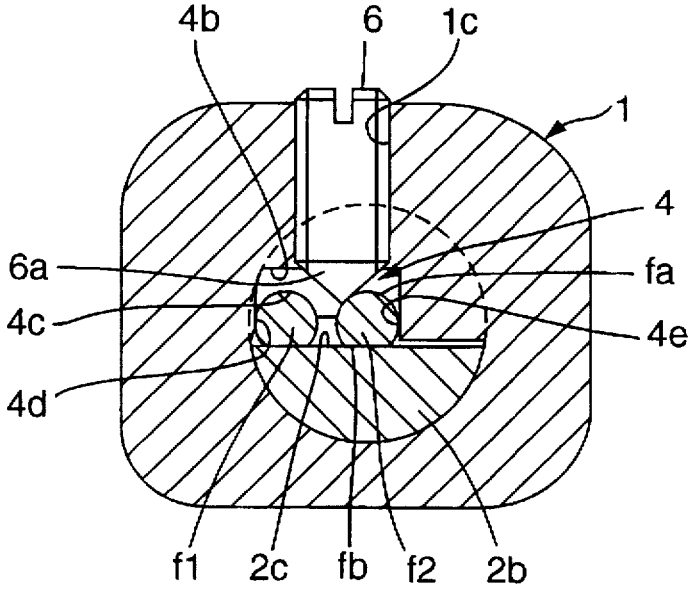
FIG. 10 is a cross sectional view of the needle clamping mechanism taken along X—X in FIG. 2.
Figure 11:
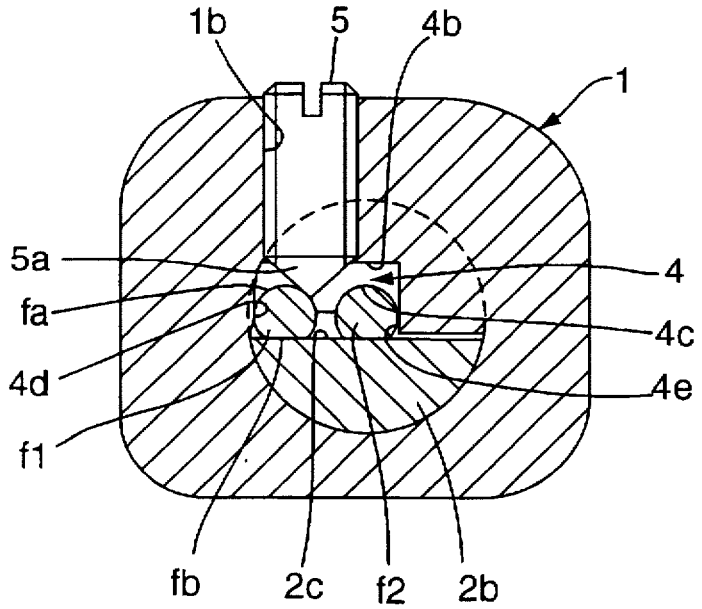
FIG. 11 is a cross sectional view of the needle clamping mechanism taken along XI—XI in FIG. 2.
Figure 12:
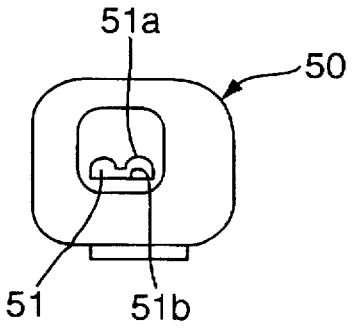
FIG. 12 is a plan view of a prior art needle clamping member.
Figure 13:
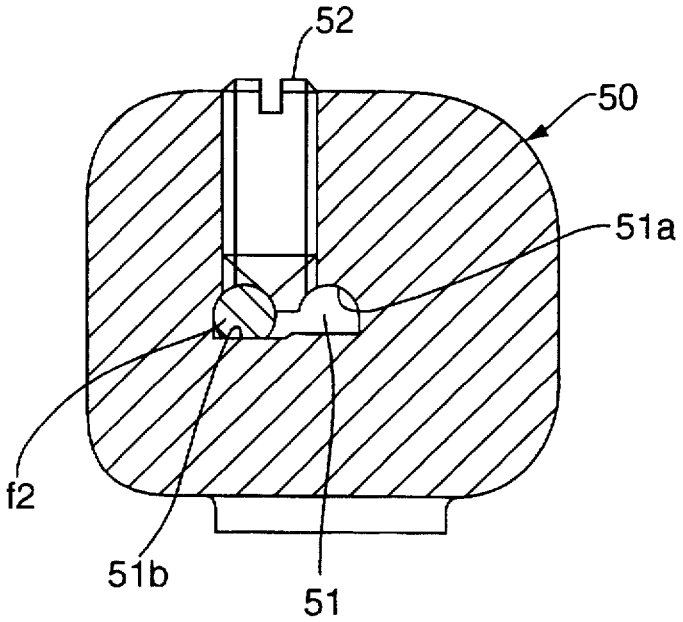
FIG. 13 is a cross sectional view of the needle clamping member in FIG. 12.
Figure 14:
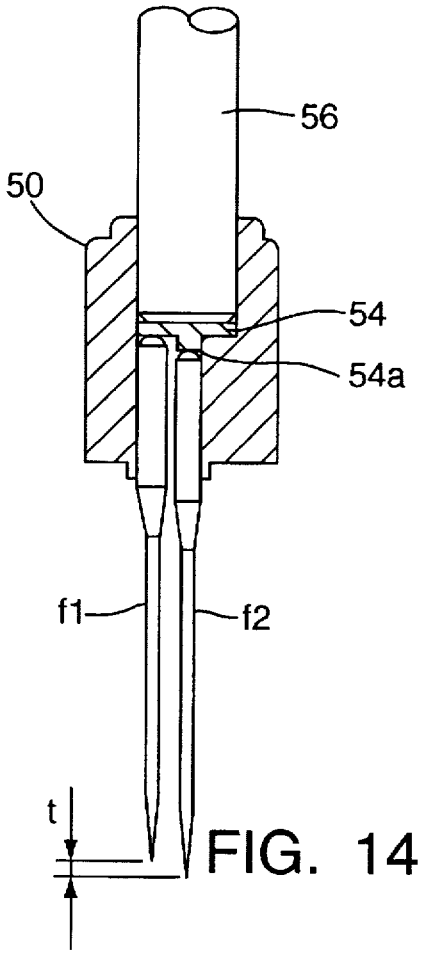
FIG. 14 is a cross sectional view of a prior art needle clamping mechanism as viewed from the front thereof.
Figure 15:
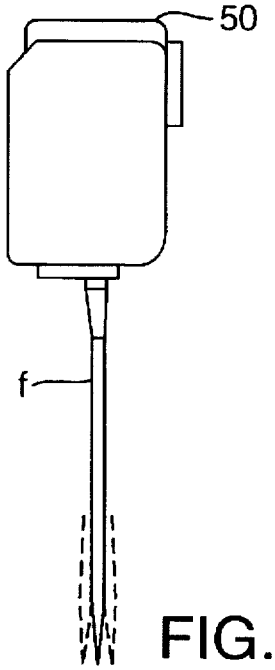
FIG. 15 is a view for explaining the drawback of the needle clamping mechanism in FIG. 14.
Figure 16:
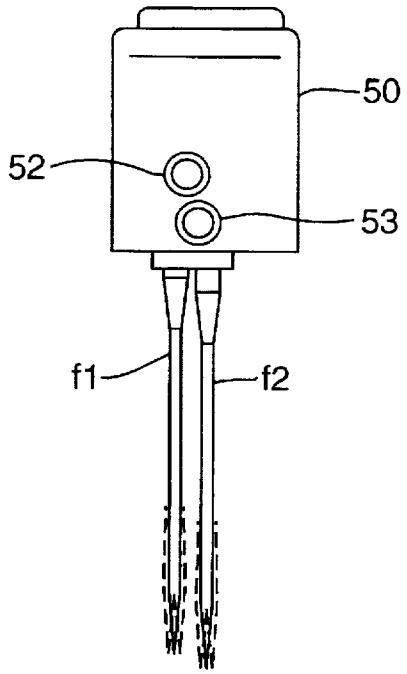
FIG. 16 is a view for explaining the operation of the needle clamping mechanism in FIG. 14.
Figure 17:
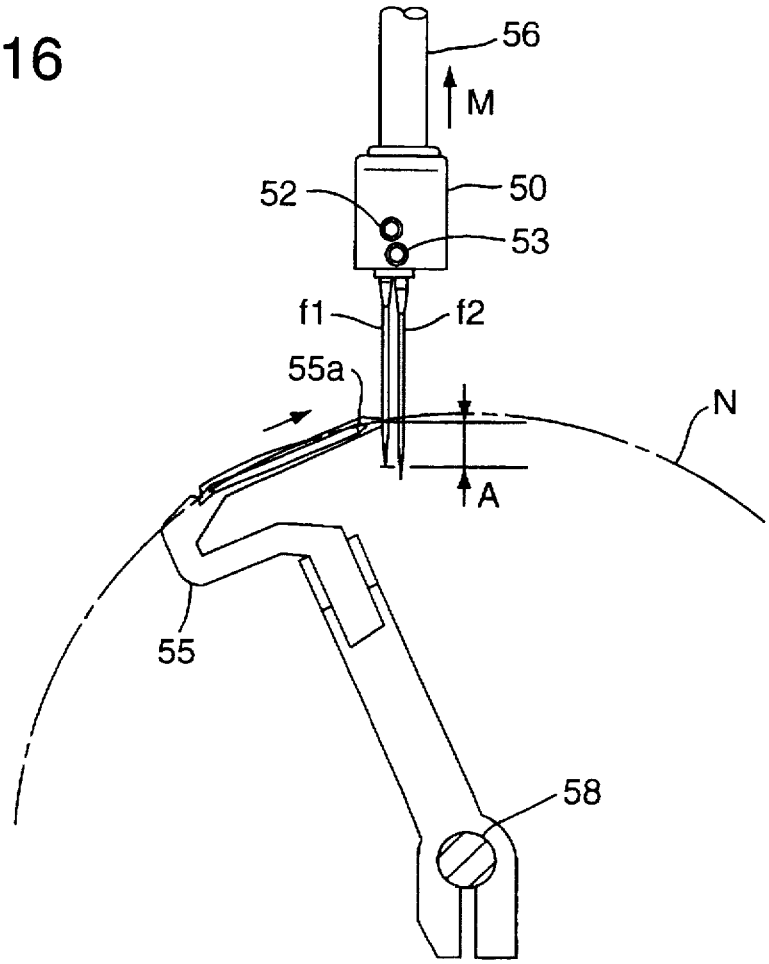
FIG. 17 is a view for explaining the operation of the needles and the left looper in FIG. 14.
Figure 18:
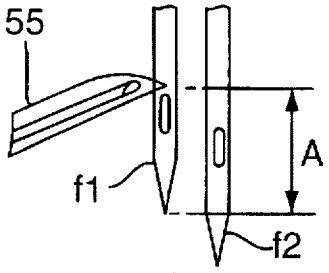
FIG. 18 is an enlarged view of the main portion of FIG. 17.
Figure 19:
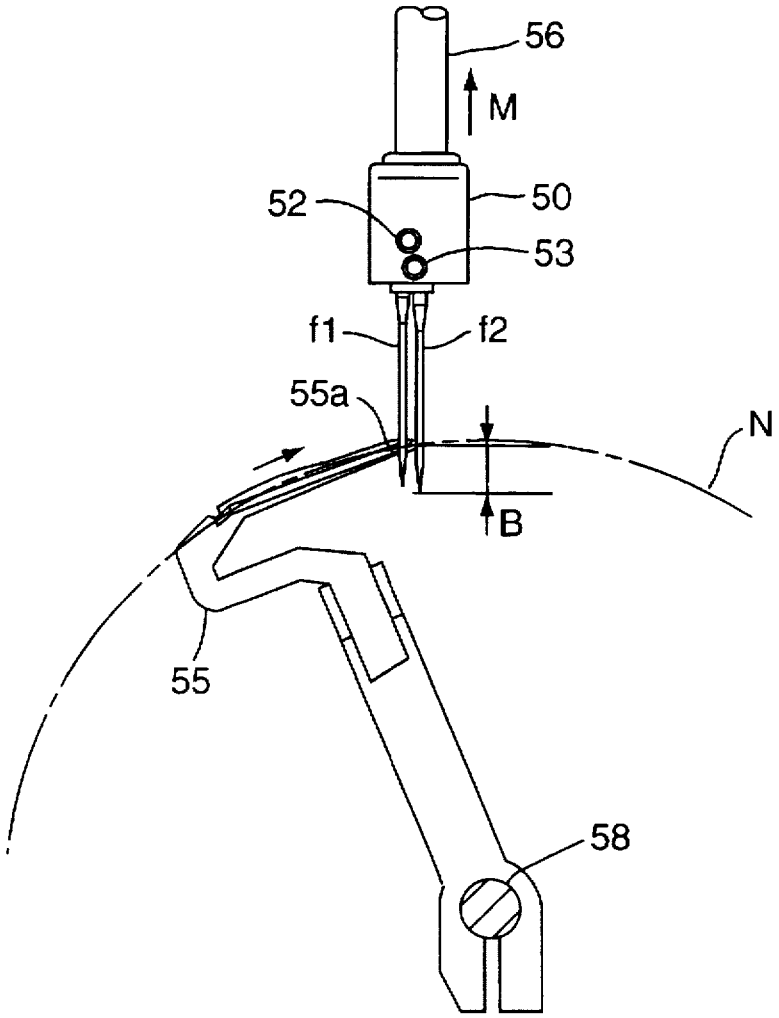
FIG. 19 is a view for explaining the operation of the needles and the left looper in FIG. 14.

Two needles f are detachably fitted to the needle clamp member 1 in a state where they extend in parallel with the axial line of the needle bar 2. Two needles f comprise a left needle f1 and a right needle f2 as viewed from the front thereof. Accordingly, the needle clamp member 1 has a needle containing hole 4 which is connected to a recess 1*a* for receiving the needle bar body 2*a*. The upper ends of the needles f1 and f2 have the needle circular portions fa and the needle flat surface portion fb formed by the chord of the needle circular portions fa as shown in FIGS. 10 and 11.

The needle containing hole 4 of the needle clamp member 1 extends in parallel withi the axial line of the needle bar 2 and is opened at the lower end surface of the needle clamp member 1 as shown in FIGS. 1 through 6. The needle contaning hole 4 comprises a semicircular cross sectional portion 4*a* positioned at the back for receiving the protrusion 2*b* of the needle bar 2 and a rectangular cross sectional portion 4*b* positioned at the front for receiving the needles f1 and f2, where a pair of circular grooves 4*c* are formed at least at a part (lower end in the present embodiment) of the rectangular cross sectional portion 4*b*. Each of the circular arc grooves 4*c* is opened at the chord of the semicircular cross sectional portion 4*a* and is formed at the right and left so as to receive the needle circular portions fa formed at the upper end of the pair of needles f1 and f2 so that the needles f1 and f2 are not turned. However, the side walls 4*d* and 4*e* formed by the left and right end surfaces of the rectangular cross sectional portion 4*b* of the needle containing hole 4 are formed to protrude from the inside of the left and right end portions of the pair of circular arc grooves 4*c*, so as to avoid that the outer peripheral surfaces of the needle circular portions fa of the needles f1 and f2 are pressed against the side walls of the circular arc grooves 4*c* in a state where the two needles f1 and f2 are fitted in the needle containing hole 4 of the needle clamp member 1.

Whereupon, the two needles f are respectively received by the circular arc grooves 4*c* of the needle containing hole 4 and are arranged in parallel with each other in the direction perpendicular to the feeding direction of the sewn cloth. The pair of needles f1 and f2 which are arranged with each other and respectively received by the pair of circular arc grooves 4*c* are respectively detachably fitted to the needle clamp member 1 by a pair of needle clamp screws 5 and 6 which are screwed into the needle clamp member 1. That is, the pair of needle clamp screws 5 and 6 are respectively screwed into the screw holes 1*b* and 1*c* respectively defined in the needle clamp member 1 as shown in FIGS. 10 and 11. As a result, the conical tip end portions 5*a*, 6*a* of the needle clamp screws 5 and 6 enter between the two needles f1 and f2, whereby the conical tip end portion 5*a* of the needle clamp screw 5 is pressed against the left needle f1 and the conical tip end portion 6*a* of the needle clamp screw 6 is pressed against the right needle f2. In this state, each of the needle flat surface portions fb formed by the chord of the needle circular portions fa at the upper ends of each of the needles f1 and f2 is pressed against the flat surface portion 2*c* of the needle bar 2 while each of the needle circular portions fa is pressed against the side walls 4*d* and 4*e* of the rectangular cross sectional portion 4*b* so that the needle flat surface portions fb and needle circular portions fa are, respectively positioned. Since the side walls 4*d* and 4*e* of the rectangular cross sectional portion 4*b* are respectively flat, it can be manufactured with relatively excellent accuracy, even if the needle clamp member 1 is manufactured by casting.

The operation of the needle clamping mechanism will be now described.

Figure 1:
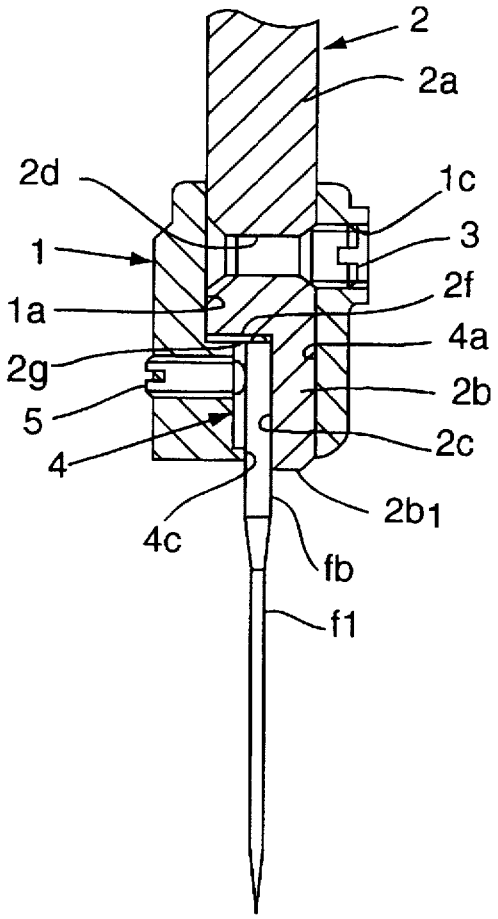
FIG. 1 is a cross sectional view of a needle clamping mechanism of an overlock sewing machine as viewed from a side thereof according to a preferred embodiment of the present invention.

The needle bar 2 is supported by an arm of the overlock sewing machine at its upper end. The needle bar 2 is engaged in the needle clamp member 1 at its lower end, then the set screw 3 is screwed into the needle clamp member 1 so as to detachably fit the needle bar 2 to the needle clamp member 1. At this time, the needle bar body 2*a* is inserted into the recess 1*a* of the needle clamp member 1, and the protrusion 2*b* of the needle bar 2 is inserted into the semicircular cross sectional portion 4*a* of the needle containing hole 4, then the set screw 3 is screwed into the female screw portion 1*c* of the needle clamp member 1 so that the shaft of the set screw 3 is retained by the through hole 2*d*. In this state, the lower end of the protrusion 2*b* slightly protrudes from the lower surface of the needle clamp member 1 so as to form a protrusion end portion 2*b*1 as shown in FIGS. 1 and 2.

The two needles f1 and f2 are sequentially fitted in the needle containing hole 4 of the needle clamp member 1. When the left needle f1 is fitted into the needle containing hole 4, it is inserted from the left lower end part of the needle containing hole 4, and then it is retained by the left circular arc grooves 4*c*. At this time, the left needle f1 is moved upward after the needle flat surface portion fb is brought into contact with and guided by the flat surface portion 2*c* of the protrusion end portion 2*b*1, then it is further moved upward while it is retained by the left circular arc grooves 4*c*, then the upper end surface of the left needle f1 is brought into contact with the upper surface 2*f* of the notch groove portion 2*e*. Thereafter, the needle clamp screw 5 is screwed into a screw hole 1*b* of the needle clamp member 1 as shown in FIG. 11. As a result, the conical tip end portion 5*a* of the needle clamp screw 5 is pressed against the inner peripheral portion of the needle circular portion fa of the left needle f1. In this state, the outer peripheral portion of the needle circular portion fa of the left needle f1 is pressed against the side wall 4*d* formed by the left end surface of the needle containing hole 4 while the needle flat surface portion fb formed by the chord of the needle circular portion fa at the upper end of the left needle f1 is pressed against the flat surface portion 2*c* of the needle bar 2, thereby positioning the left needle f1.

Further, when the right needle f2 is fitted into the needle containing hole 4, it is inserted from the right lower end part of the needle containing hole 4, and then it is retained by the right circular arc grooves 4*c*. At this time, the right needle f2 is moved upward after the needle flat surface portion fb is brought into contact with and guided by the flat surface portion 2*c* of the protrusion end portion 2*b*1, then it is further moved upward after it is retained by the left circular arc grooves 4*c*, then the upper end surface of right needle f2 is brought into contact with the lower surface 2*g* of the notch groove portion 2e wherein the notch groove portion 2c is not formed. Thereafter, the needle clamp screw 6 is screwed into a screw hole 1c of the needle clamp member 1 as shown in FIG. 10. As a result, the conical tip end portion 6a of the needle clamp screw 6 is pressed against the inner peripheral portion of the needle circular portions fa of the right needle f2. In this state, the outer peripheral portion of the needle circular portions fa of the right needle f2 is pressed against the side wall 4e formed by the right end surface of the needle containing hole 4 while the needle flat surface portion fb formed by the chord of the needle circular portion fa at the upper end of the right needle f2 is pressed against the flat surface portion 2c of the needle bar 2, thereby positioning the right needle f2.

Figure 2:
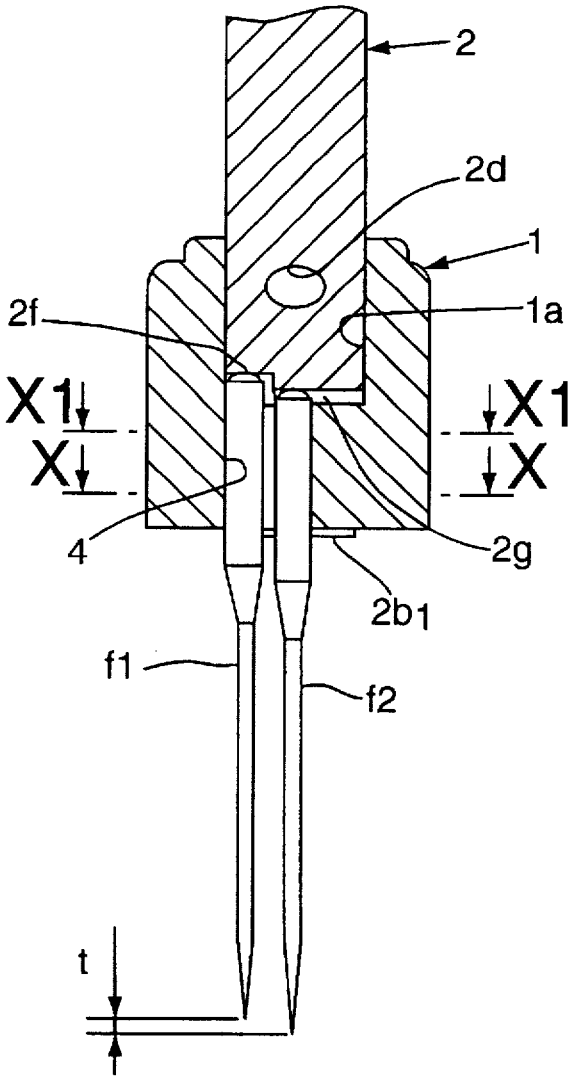
FIG. 2 is a cross sectional view of the needle clamping mechanism in FIG. 1 as viewed from a front thereof.
Figure 3:
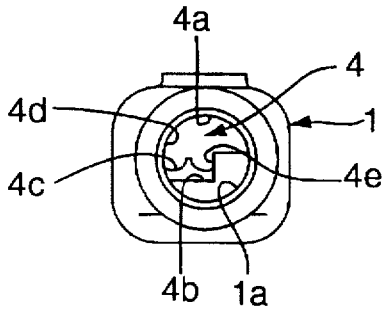
FIG. 3 is a plan view of a needle clamping member in FIG. 1.
Figure 4:
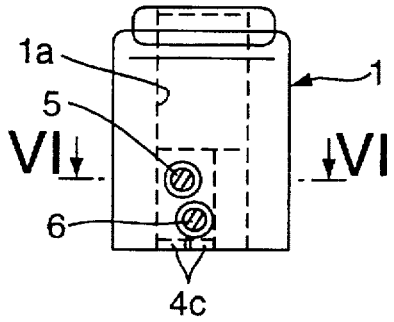
FIG. 4 is a rear view of the needle clamping member in FIG. 1.
Figure 5:
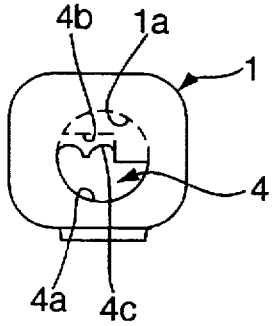
FIG. 5 is a bottom view of the needle clamping member in FIG. 1.
Figure 6:
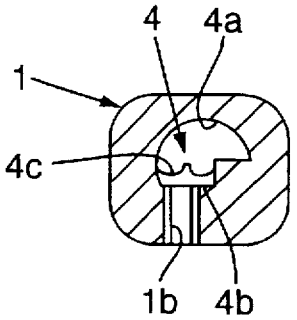
FIG. 6 is a cross sectional view taken along the line VI—VI in FIG. 4.

Accordingly, there is formed the difference t at the lower end positions of the two needles f1 and f2 having the same length in a state where the two needles f1 and f2 fitted in the needle containing hole 4 of the needle clamp member 1, as shown in FIG. 2, owing to the difference $t_0$ between the lower surface 2g of the needle bar body 2a where the notch groove portion 2e is not formed and the upper surface 2f of the notch groove portion 2e.

As is understood from the above explanation, the following effects can be obtained by the present invention.

According to the first aspect of the invention, since the flat surface portion of the protrusion of the needle bar has a machining surface, thereby providing accuracy. Further, the needle containing hole of the needle clamp member is rectangular, thereby providing accuracy in shape. Still further, since each needle is pressed against and fixed to the flat surface portion and both side walls of the needle containing hole, it can excellently prevent the tip end positions of the needles from being set back or forth and right or left.

As a result, a stable stitch is carried out.

According to the second aspect of the invention, the difference between the tip end positions of the left and right needles is set in such a manner that the upper end surface of the left needle is brought into contact with the upper surface of the notch groove portion, and the upper end surface of the right needle is brought into contact with the lower surface of the needle bar body connected to the upper end of the flat surface portion. As a result, it is possible to set the difference between the tip end positions of the left and right needles with a simple structure and with high accuracy and low cost.

According to the third aspect of the invention, the lower end portion of the protrusion of the needle bar protrudes from the lower surface of the needle clamp member, so that it can be used as a guide for fitting the needles. As a result, the needles can be easily fitted.

What is claimed is:

1. A needle clamping mechanism comprising:

a needle bar including a needle bar body having a circular cross section, a protrusion protruding downwardly from a lower surface of the needle bar body having a semicircular cross section, and a flat surface portion at a chord thereof;

a needle clamp member engaged with and fixed to the needle bar, the needle clamp member having a recess that is circular in cross section at an upper end for receiving the needle bar body;

a needle containing hole defined by the recess and extending approximately parallel to the needle bar body, the needle containing hole being open at a lower end surface of the needle clamp member, and having a semicircular cross sectional portion for receiving the protrusion of the needle bar and a pair of circular arc grooves which receive the needle circular portions provided at upper ends of a pair of needles;

wherein the needles received in the circular arc grooves are pressed by tip ends of set screws which are engaged with the needle clamp member, each of the needle circular portions being pressed against each of the side walls of the needle containing hole, a needle flat surface portion formed by a chord of the needle circular portions at the upper end of each of the needles is pressed against and fixed to the flat surface portion of the protrusion;

the protrusion and the needle bar body cooperating to define a groove approximately perpendicular to the flat surface portion; and wherein an upper end surface of the left needle is brought into contact with an upper surface of the groove with the upper end surface of the right needle in communication with a lower surface of the needle bar body such that a difference is set between tip end positions of the needles.

2. A needle mechanism according to claim 1, wherein the lower end of the protrusion of the needle bar protrudes from the lower surface of the needle clamp member.

* * * * *

UNITED STATES PATENT AND TRADEMARK OFFICE

CERTIFICATE OF CORRECTION

PATENT NO. : 5,775,244
DATED : July 7, 1998
INVENTOR(S) : Koichi Nakayama and Shinji Kojima It is certified that error appears in the above-identified patent and that said Letters Patent is hereby corrected as shown below:

Title page, item [57]:

On Line 18, please delete "[o0:]" and substitute --of--.

Signed and Sealed this

Twenty-seventh Day of October, 1998

*Attest:*

*Attesting Officer*

BRUCE LEHMAN

*Commissioner of Patents and Trademarks*